United States Patent [19]

Wilson

[11] Patent Number: 4,552,216

[45] Date of Patent: Nov. 12, 1985

[54] METHOD OF PRODUCING A STRATIFIED VISCOUS OIL RESERVOIR

[75] Inventor: Robert Wilson, Plano, Tex.

[73] Assignee: Atlantic Richfield Company, Los Angeles, Calif.

[21] Appl. No.: 623,256

[22] Filed: Jun. 21, 1984

[51] Int. Cl.[4] ..... E21B 43/243

[52] U.S. Cl. ..... 166/261; 166/256; 166/268; 166/272

[58] Field of Search ..... 166/245, 256, 257, 258, 166/261, 263, 268, 272

[56] References Cited

U.S. PATENT DOCUMENTS

| | | | |
|---|---|---|---|
| 2,584,605 | 2/1952 | Merriam et al. | 166/257 |
| 3,010,512 | 11/1961 | Hurley et al. | 166/258 |
| 3,072,185 | 1/1963 | Bond et al. | 166/261 |
| 3,174,543 | 3/1965 | Sharp | 166/256 |
| 3,294,167 | 12/1966 | Vogel | 166/258 X |
| 3,599,714 | 8/1971 | Messman et al. | 166/258 |
| 3,675,715 | 7/1972 | Speller, Jr. | 166/256 |
| 4,415,031 | 11/1983 | Hunt, III | 166/266 X |
| 4,429,745 | 2/1984 | Cook | 166/261 X |

OTHER PUBLICATIONS

Chu, "Current In-Situ Combustion Technology", *Journal of Petroleum Technology,* Aug. 1983, pp. 1412–1418.

*Primary Examiner*—George A. Suchfield

*Attorney, Agent, or Firm*—M. David Folzenlogen

[57] ABSTRACT

This invention discloses a more efficient and more self supporting method of producing oil from a viscous oil-bearing permeability stratified reservoir. In situ combustion with oxygen is carried out near a first injection well in a manner such that carbon dioxide substantially free of nitrogen is produced. The carbon dioxide substantially free of nitrogen produced by in situ combustion is then injected into a second injection well to swell, reduce the vicosity of in-place oil and displace oil from a separate part of the stratified reservoir. Water with or without other mobility and solubility control agents can be injected in either or both the combustion step and carbon dioxide displacement step. In situ combustion with or without nitrogen may thereafter be initiated adjacent the second injection well to produce the less permeable or more viscous oil-bearing strata to either produce oil left by carbon dioxide injection or to produce more nitrogen-free carbon dioxide. This additional carbon dioxide plus carbon dioxide produced in the second production well can then be injected into a third laterally spaced injection well to sweep and displace oil from another part of the reservoir. These steps may be repeated until the reservoir is economically depleted.

12 Claims, 1 Drawing Figure

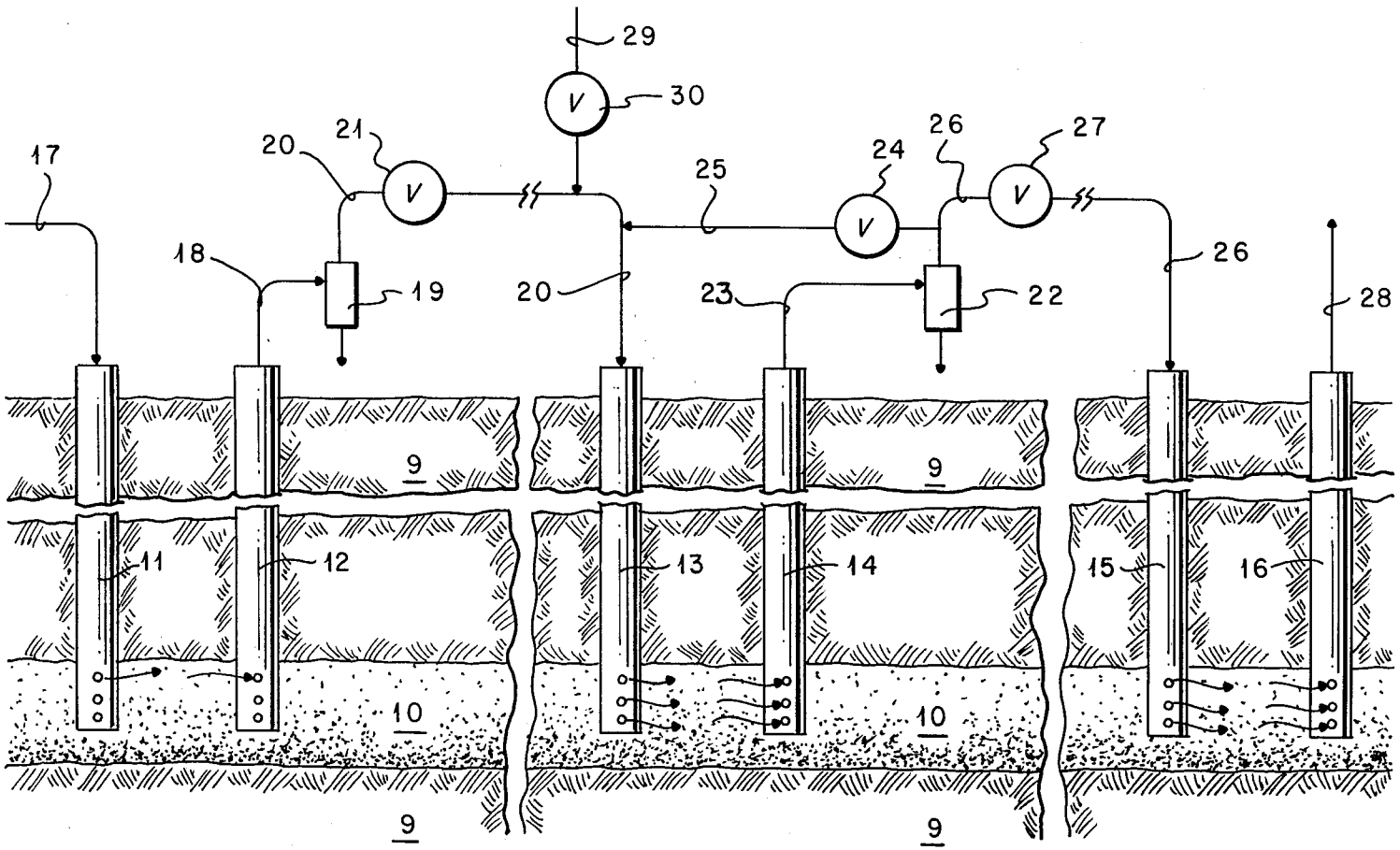
28
26
27
22
26
24
25
23
29
30
20
21
19
20
18
17
16
15
14
13
12
11
9
10
9
9
10
9

METHOD OF PRODUCING A STRATIFIED VISCOUS OIL RESERVOIR

BACKGROUND OF THE INVENTION

This invention relates to the recovery of viscous hydrocarbons from "permeability" stratified subterranean reservoirs. More particularly, it relates to increased viscous oil production by in situ combustion with oxygen rather than air, and using the evolved nitrogen-free carbon dioxide to displace oil from another part of the reservoir.

Within stratified reservoirs are vast quantities of viscous hydrocarbons which for various reasons are not economically recoverable by conventional oil producing techniques. It has been proposed to use substantially nitrogen-free oxygen to produce oil from these stratified viscous oil reservoirs by in situ combustion. It is difficult to control combustion with pure oxygen without consuming large amounts of oil. In highly stratified reservoirs, oxygen injection causes stratifed burning mainly in the strata of highest conductivity which is also the strata of highest permeability and oil mobility. At present, it is not possible to reduce stratified flow by injection of a less mobile phase alternating or mixing with the oxygen. In situ combustion with oxygen thereby displaces only a small part of the reservoir vertical cross section.

It is an object of this invention to provide a process for increasing oil production from permeability stratified viscous oil reservoirs. An additional object of this invention is to provide an oil producing method wherein in situ combustion may be used in a way that increases oil production over the amount of oil produced by conventional in situ combustion. A further object of this invention is to increase oil production from the higher permeability, more mobile oil strata. A still further object of this invention is to increase oil production from the lower permeability, less mobile parts of stratified viscous oil reservoirs by in situ combustion.

SUMMARY OF THE INVENTION

This invention discloses a more efficient and more self supporting method of producing oil from a viscous oil-bearing stratified reservoir. The reservoir is penetrated by first and second injection and production wells. The wells are spaced apart from each other so that injection into and production from the first well or wells is not significantly affected by injection into and production from the second wells. In situ combustion with oxygen is conducted adjacent at least one of the injection wells. The combustion is carried out in a manner such that carbon dioxide substantially free of nitrogen is produced. In situ combustion is difficult to control and will inherently channel into the more permeable and more mobile stratum or strata. This channelling is not controlled by water injection, but water can be injected for other reasons. The in situ combustion thereby consumes some of the best oil in the reservoir. In some cases, in situ combustion with oxygen consumes most of the oil in the burned out area in these best strata. In situ combustion by itself, therefore, tends to be either inefficient, or from an oil-producing standpoint, almost valueless. But, in this invention, the carbon dioxide produced by in situ combustion is substantially free of nitrogen and can be used as an additional oil displacing media without the need for expensive nitrogen removal. The carbon dioxide substantially free of nitrogen is injected into a second injection well to swell, reduce the viscosity of in-place oil and displace oil from the reservoir. Like oxygen injection, the carbon dioxide tends to channel into the more permeable, mobile stratum or strata. Carbon dioxide injection thereby sweeps and displaces oil from the best strata in the reservoir. Moreover, the relative mobility between the oil and carbon dioxide can be significantly controlled by the addition of water with or without other mobility and solubility control agents. In addition, after carbon dioxide displacement, in situ combustion with or without nitrogen may be initiated adjacent the second injection in the same or other less permeable or more viscous oil-bearing strata to either produce oil left by carbon dioxide injection or to produce more nitrogen-free carbon dioxide. This additional carbon dioxide plus carbon dioxide produced in the second production well can then be injected into a laterally spaced injection well to sweep and displace oil from another part of the reservoir. These steps may be repeated until the reservoir is economically depleted.

DESCRIPTION OF THE DRAWING

The drawing is a diagrammatic view showing three laterally spaced well pairs for carrying out the method of the invention in a stratified subsurface oil bearing formation.

DETAILED DESCRIPTION OF PREFERRED EMBODIMENTS

Vast quantities of viscous oil exist in reservoirs stratified by permeability variations. Some strata contain oil that is mobile. Other strata contain oil that is substantially immobile at suitable injection pressures. These strata cannot be produced until the oil is heated in place to reduce its viscosity. In this invention, in the drawing in earth 9 oil is produced from stratified viscous oil-bearing subsurface reservoir 10 using at least two laterally spaced apart injection and producing wells which in conventional fashion penetrate the reservoir at points which are sufficiently spaced that injection and production from one of the wells is not significantly affected by injection and production in the other wells. In the following description of the process of this invention reference will be made to an injection well and a production well, but it is to be understood that any number of wells and any form of well patterns may be used so long as such wells conform to the limitations set forth herein. Accordingly, in the drawing, there is shown injection well 11 and producing well 12 forming a first pair of wells, and injection well 13 and producing well 14 forming a second pair of wells, and injection well 15 and producing well 16 forming a third pair of wells. Each pair of wells is laterally spaced from the other pairs of wells. For in situ combustion, the injection well and production well could be the same well used alternately, but not simultaneously, as an injection well and a production well.

In situ combustion is initiated by known conventional means in reservoir 10 at a point adjacent injection well 11 penetrating the reservoir and a combustion supporting oxygen containing gas in injected into the reservoir via injection line 17. This combustion supporting gas is characterized by the fact that when oil in the reservoir is burned the products of combustion contain essentially nitrogen-free carbon dioxide. Pure oxygen is preferred, but other gaseous substances may be added provided that they are not nitrogen or substances containing or producing gaseous nitrogen. For a later second stage of this process, it is essential that the carbon dioxide produced by combustion be substantially free of nitrogen, that is, contain 6% and preferably less of nitrogen. The amount of oxygen injected and injection pressure depend on the stratum or strata of the reservoir to be burned, the amount of oil in place and its composition, the amount of oil burned, and the temperature. These vary from reservoir to reservoir and need to be evaluated and determined in n each case by known conventional means. It is expected that the amount of oxygen injected will vary between 25 and 2000 standard cubic feet per reservoir barrel traversed by the burn front and that the injection pressure will be below the gas fracturing pressure of the reservoir in its original state.

After combustion has been carried out long enough, water may be injected to control the temperature of the combustion front and/or to be vaporized and forced or moved with the products of combustion to displace heated oil toward a producing well where the oil is produced and/or the products of combustion containing substantially nitrogen-free carbon dioxide are produced. As an alternative, after sufficient combustion, the injection well may be converted into a producing well and the formation fluids and products of combustion backflowed into the converted well. This latter procedure is a form of huff and puff. This huff and puff cycle of burning and backflowing may be practiced repeatedly at any suitable time intervals designed to produce oil and/or carbon dioxide substantially free of nitrogen.

After the total rate of carbon dioxide production via line 18 and optional carbon dioxide separator 19 from producing well 12, including the combustion wells and other wells in the reservoir producing nitrogen-free carbon dioxide, is sufficient to support carbon dioxide displacement by known methods, the carbon dioxide is injected via line 20 and valve 21 into injection well 13 penetrating a part of the reservoir spaced apart from the area subjected to in situ combustion. Accordingly, carbon dioxide is injected at a pressure below the fracturing pressure of the oil-bearing formation. It is preferred that the pressure be as high as practical since the solubility of carbon dioxide and oil increases with increasing pressure especially at pressures above 700 psi. The carbon dioxide swells and decreases the viscosity of the oil. Light hydrocarbons in the oil tend to transfer to the carbon dioxide. Miscibility may be developed in some reservoirs. In general miscibility will not be reached at injection pressures below the formation fracturing pressure in relatively shallow viscous oil wells. The formation fracturing pressure is dependent on the depth of the reservoir. The carbon dioxide is injected at a pressure above the formation pressure. It, therefore, increases the reservoir pressure and displaces oil from strata that are conductive enough for mobilization and displacement of the oil. For illustrative purposes although the carbon dioxide will tend to override the oil in formation 10, all strata are shown as displaceable because the mobility of carbon dioxide may be controlled by various known techniques. The oil is produced at production well 14 associated with injection well 13 via line 23 and optional separator 22. The injected carbon dioxide will channel to the more conductive strata, that is, the strata of higher permeability containing oil that is mobile of capable of being mobilized at ordinary reservoir temperatures. In addition, at immiscible conditions, the carbon dioxide will be the lighter, more mobile phase. It will tend to override the oil in the strata. Water may be injected with or alternated with the carbon dioxide in accordance with principles described in U.S. Pat. No. 3,096,821 to A. B. Dyes to better balance mobility and gravity. The amount of carbon dioxide, with or without water, will vary for different reservoirs and oil characteristics in a given stratum within the reservoir. The amount injected is dependent on reservoir pore volume in the area to be swept by the carbon dioxide, hydrocarbon pore volume, water pore volume, solubilities, pressure, temperature and other conventional reservoir characteristics. The amount of carbon dioxide and water injected will also depend on the characteristics of the water and the additives used in the water. Thickening agents, surfactants, polymers and the like may be added to the water if economically justified. The principles involved and the pressures and amounts used are determined by conventional reservoir calculations, laboratory test and field experience. In general, if water is used to control the mobility and channelling or override of the carbon dioxide, it is expected that the ratio of the water to carbon dioxide will vary between 0.5 and 9.0. After sufficient carbon dioxide has been injected, water alone may be injected to drive the previously injected carbon dioxide to the producing wells. Water drive or carbon dioxide injection may be terminated or suspended when the process is no longer economical.

If after a time carbon dioxide is produced, it will be substantially free of nitrogen and it may be injected either into the same well pattern via line 26 through valve 24 and lie 25 to line 20 and into injection 13 or via line 26 and valve 27 or into a third separate pattern represented by injection well 15 and production well 16 where the carbon dioxide flows through formation 10 and oil and eventually carbon dioxide are produced from production well 16 via line 28. If the carbon dioxide is injected into a third laterally spaced apart injection well, the carbon dioxide injection steps with or without the water will be repeated using the reservoir characteristics in this different distinct area of the formation. This enhances the amount of oil produced by the carbon dioxide produced during the initial in situ combustion step of the process. If the carbon dioxide is reinjected into the same area of the reservoir and it is believed that all of the oil capable of being economically produced by further carbon dioxide injection has been produced from the strata swept, conventional permeability reducing substances may be injected so that further carbon dioxide injection will flow to and sweep other displaceable stratum or strata of the reservoir.

After carbon dioxide injection in second injection well 13 is discontinued, in situ combustion may be initiated by shutting off carbon dioxide valve 21 and injecting oxygen without nitrogen via optional line 29 and valve 30 adjacent the second injection in a manner similar to that previously described, except that in this second burn air may be used if desired. However, it is preferred that oxygen sunstantially free of nitrogen be used if the carbon dioxide produced by this second stage of in situ combustion is to be produced and injected in either a third well pattern or an additional well pattern. This second stage of in situ combustion may be preceded by injecting conventional permeability-reducing agents to decrease the conductivity of the reservoir area previously swept by carbon dioxide injection. Alternatively, if sufficient residual hydrocarbons are present in the previously swept area, the second stage of in situ combustion may be conducted in this partially depleted area to apply heat to the overlying or underlying stratum or strata thereby causing a pressure increase in these strata and decreasing the viscosity of the viscous oil to the point that oil from these strata is produced.

From the foregoing description, it will be apparent that the present invention provides a novel recovery method by which increased amounts of oil may be recovered from stratified viscous oil-bearing reservoirs by at least one stage of in situ combustion carried out under conditions such that substantially nitrogen-free carbon dioxide is produced and at least one stage of injection of the carbon dioxide produced in the in situ combustion stage. The method requires no substantial alternation in apparatus previously employed for injecting liquids and gases into subterranean formations and may be easily practiced by those having average training and experience in miscible flood secondary recovery techniques.

Although the process of the invention has been described with a certain degree of particularity in order to convey, by example, a basic understanding of the invention sufficient to enable one of average skill in the art of petroleum production to practice the invention, it is to be expended that the specific conditions and ranges of some parameters herein described may be altered in some degree without departure from the basic principles underlying the invention. It is therefore intended that alterations and modifications which do not entail an abandonment of the basic concepts upon which the invention is based shall be considered as circumscribed by the spirit and scope of the invention except as the same may be necessarily limited by the appended claims or reasonable equivalents thereof.

I claim:

1. In a method of producing oil from a viscous oil-bearing subsurface reservoir, said reservoir being stratified by permeability variations and being penetrated at spaced points by a first injection well and a first producing well and being penetrated by a second injection well and a second producing well, said first injection and producing wells being located to penetrate a first part of said reservoir and said second injection and producing wells being located to penetrate a second part of said reservoir, said first and said second parts of said reservoir being spaced laterally from each other, said method comprising initiating combustion in said reservoir at a point adjacent said first injection well and injecting into said first injection well a combustion supporting free oxygen containing gas characterized by the fact that the products of combustion contain essentially nitrogen-free carbon dioxide, producing said carbon dioxide from said reservoir through said first producing well, injecting said carbon dioxide into said second injection well, and producing oil from said reservoir through said second producing well.

2. The method of claim 1 wherein said combustion supporting gas is essentially pure oxygen.

3. The method of claim 1 wherein water is injected into said first injection well with said combustion supporting gas.

4. The method of claim 3 wherein said combustion supporting gas is essentially pure oxygen.

5. The method of claim 1 wherein water is injected into said second well with said carbon dioxide.

6. The method of claim 5 wherein said combustion supporting gas is essentially pure oxygen.

7. The method of claim 5 wherein water is injected into said first injection well with said combustion supporting gas.

8. The method of claim 7 wherein said combustion supporting gas is essentially pure oxygen.

9. The method of claim 5 wherein after injection of carbon dioxide and water into said second injection well, combustion is initiated in said reservoir at a point adjacent said second injection well and a combustion supporting free oxygen containing gas is injected into said second injection well.

10. The method of claim 9 wherein said combustion supporting free oxygen containing gas is essentially free of nitrogen.

11. The method of claim 10 wherein said reservoir is penetrated by a a third injection well and a third producing well, carbon dioxide essentially free of nitrogen is produced from said second production well, and said carbon dioxide is injected into said third injection well.

12. The method of claim 11 wherein water is injected into said third injection well with said carbon dioxide.

* * * * *